US007766799B1

(12) United States Patent
Chen

(10) Patent No.: US 7,766,799 B1
(45) Date of Patent: Aug. 3, 2010

(54) BOXING TRAINING DEVICE

(76) Inventor: Yi-Lin Chen, 6980 Whiteoak Drive, Richmond, B.C. (CA) V7E 4Z9

( * ) Notice: Subject to any disclaimer, the term of this patent is extended or adjusted under 35 U.S.C. 154(b) by 0 days.

(21) Appl. No.: 12/572,248

(22) Filed: Oct. 1, 2009

(51) Int. Cl.
*A63B 69/34* (2006.01)

(52) U.S. Cl. ..... 482/85

(58) Field of Classification Search ..... 482/83–87, 482/90; 206/579
See application file for complete search history.

(56) References Cited

U.S. PATENT DOCUMENTS 1,612,796 A * 1/1927 Abraham ..... 482/90
3,183,000 A * 5/1965 Dix ..... 473/417
4,486,016 A * 12/1984 Rubin ..... 482/90
5,377,976 A * 1/1995 Matherne et al. ..... 473/483
6,390,958 B1 * 5/2002 Chu ..... 482/90
7,226,398 B2 * 6/2007 Fu ..... 482/85
2007/0099771 A1 * 5/2007 Fu ..... 482/83

* cited by examiner

*Primary Examiner*—Fenn C Mathew
*Assistant Examiner*—Andrew M Tecco

(57) ABSTRACT

A boxing training device of the present invention includes a base, a support portion and a hit portion. The support portion is disposed on the base, and the hit portion is disposed on the support portion. The hit portion may he stored in a cavity defined by a bottom surface of the base while being removed from the support portion. Therefore, the storage space of the present invention is reduced.

7 Claims, 4 Drawing Sheets

BOXING TRAINING DEVICE

BACKGROUND OF THE INVENTION

1. Field of the Invention

The present invention relates to a boxing training device, and more particularly to a collapsible boxing training device.

2. Description of the Prior Art

A boxing training device, as disclosed in TW510239, has a base stuffed with ballast, a rod disposed on the base, and a hit portion disposed on the rod. Although such conventional boxing training device is collapsible, the separate parts thereof have to be stored independently, resulting in the increase in transportation and storage cost.

SUMMARY OF THE INVENTION

The main object of the present invention is to provide a collapsible boxing training device.

To achieve the above and other objects, the boxing training device of the present invention includes a base, a support portion and a hit portion. A bottom surface of the base is formed with a cavity. The support portion is removably installed on an upper surface of the base, and the hit portion is removably installed on a distal end of the support portion. The hit portion is adapted to be stored in the cavity as it is removed from the support portion.

The present invention will become more obvious from the following description when taken in connection with the accompanying drawings, which show, for purpose of illustrations only, the preferred embodiments in accordance with the present invention.

DETAILED DESCRIPTION OF THE PREFERRED EMBODIMENTS

Figure 1:
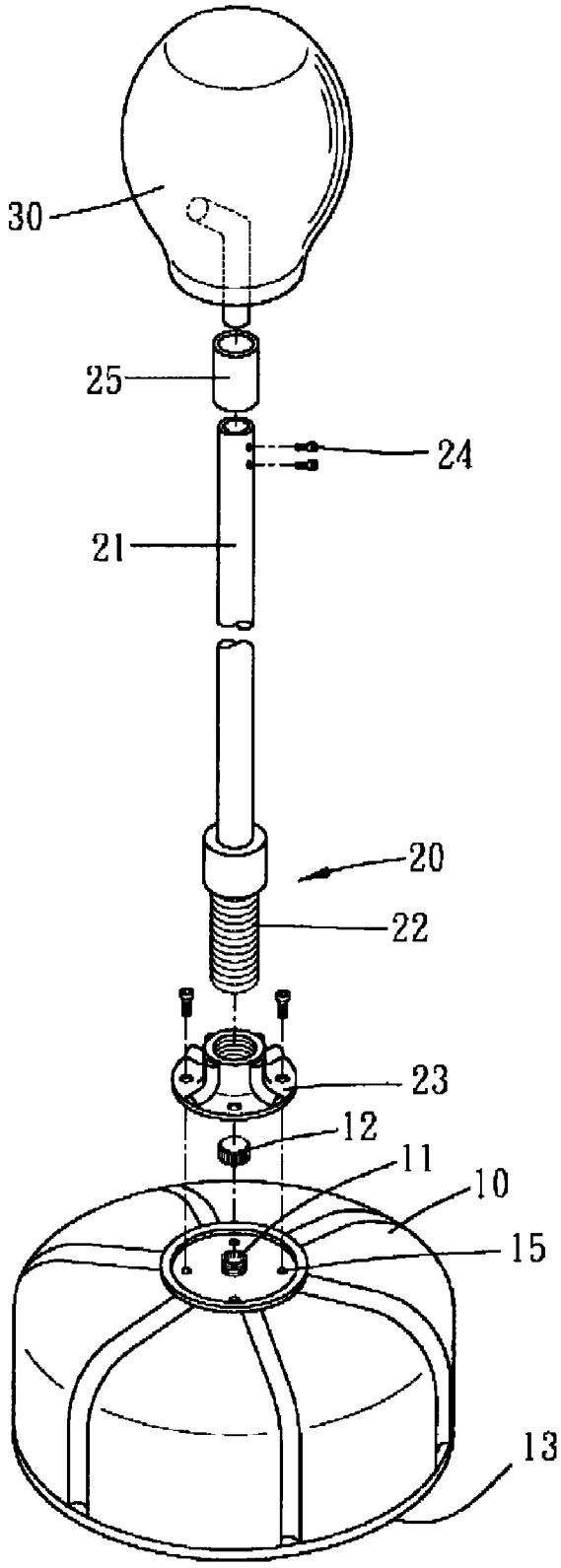
FIG. 1 is a breakdown drawing showing a device of the present invention.
Figure 2:
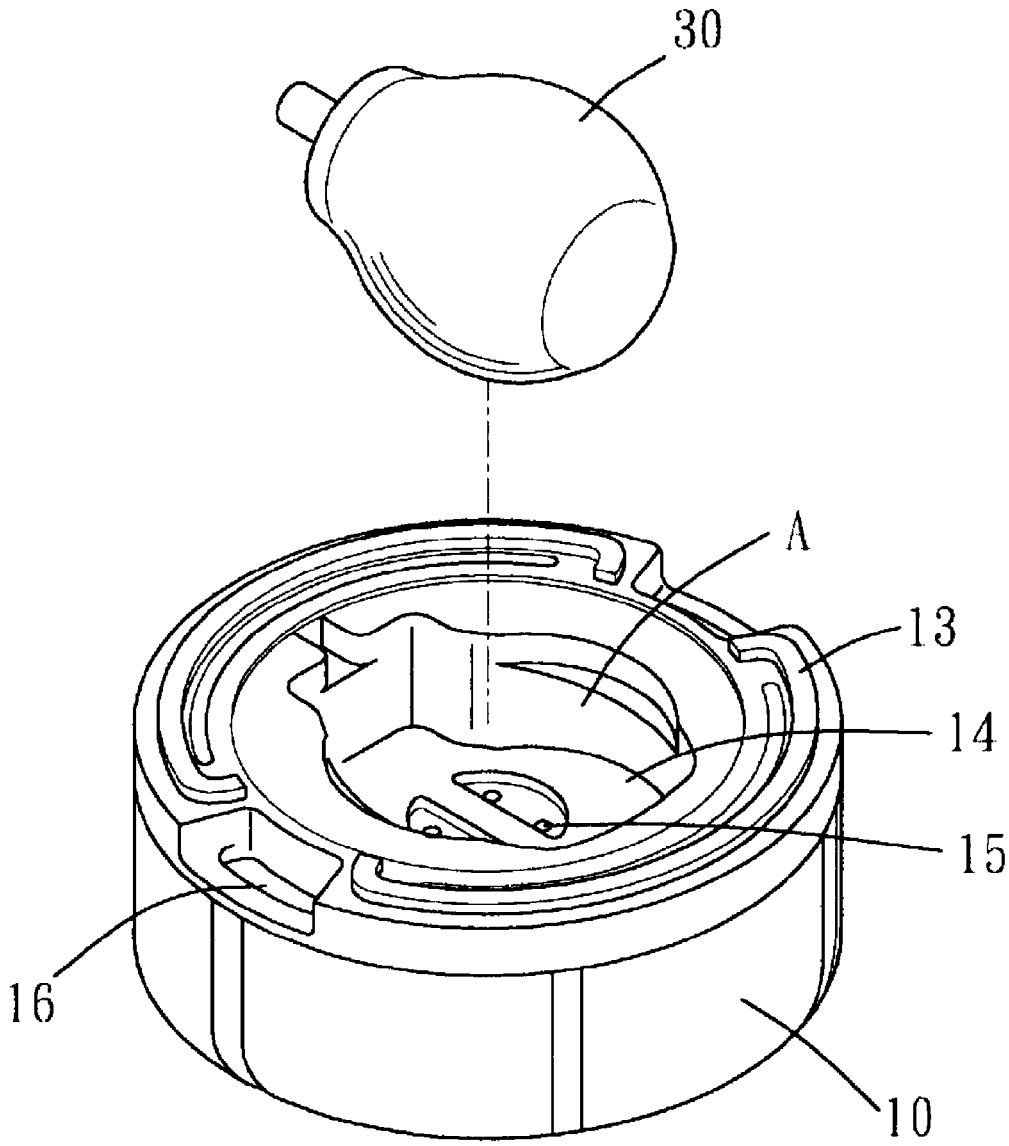
FIG. 2 is a drawing showing how to store a hit portion into a cavity of a base.
Figure 3:
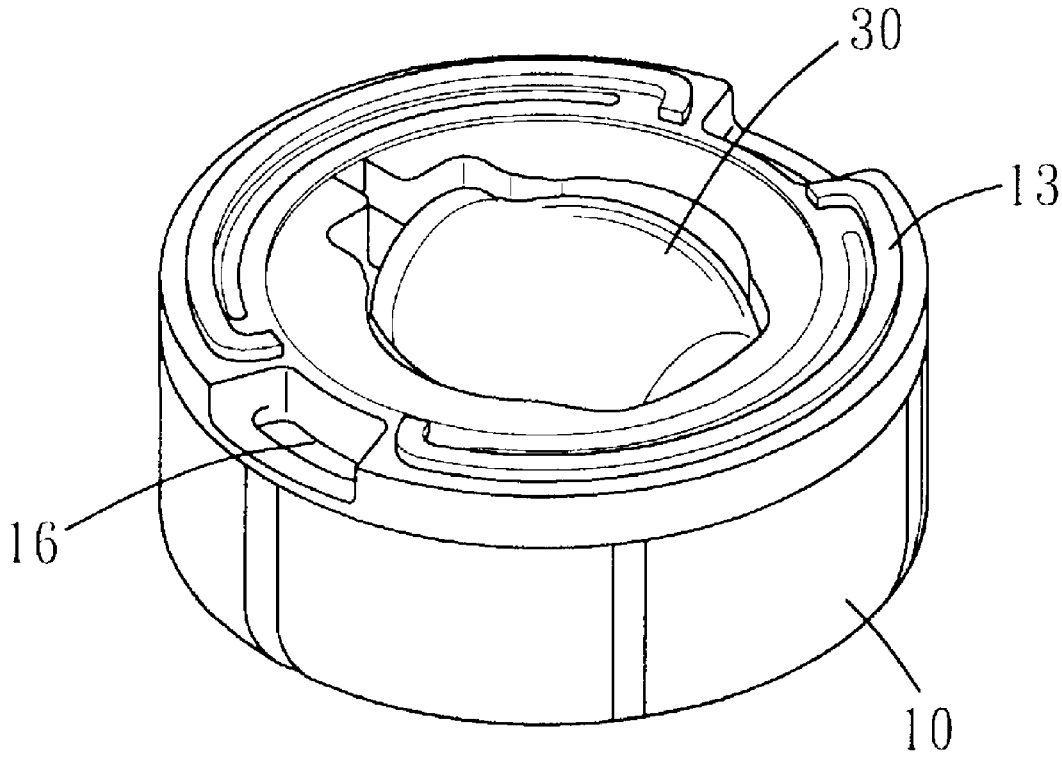
FIG. 3 is a drawing showing a hit portion stored in a cavity of a base.
Figure 4:
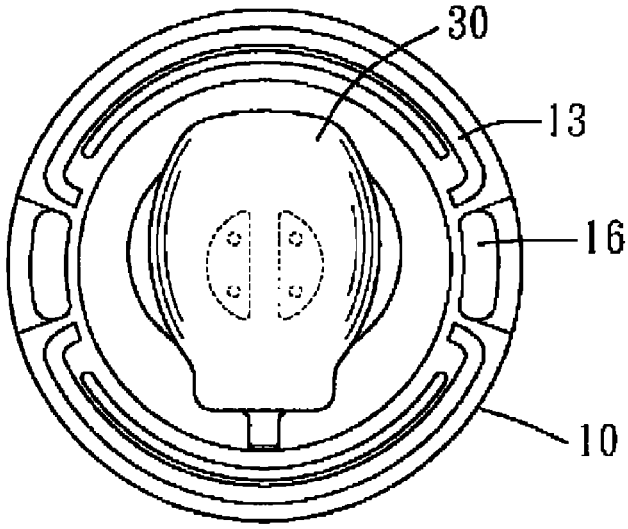
FIG. 4 is a bottom view of a device of the present invention.
Figure 5:
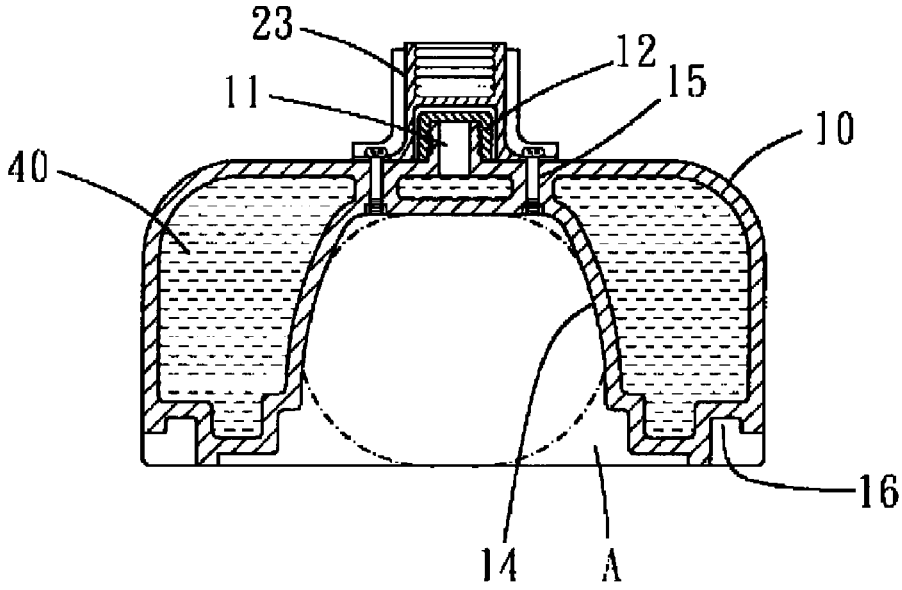
FIG. 5 is a profile showing a base of the present invention.

Please refer to FIGS. 1 and 2. A boxing training device of the present invention includes a base 10, a support portion 20 and a hit portion 30. The base 10 is a blow-molded hollow plastic body and defines a receiving chamber 40 therein. The base 10 is further formed with an opening 11 communicating the receiving chamber 40, and a cap 12 is mounted on the opening 11 to enclose the receiving chamber 40. The base 10 is usually placed on the ground, thus has a bottom surface 13 contacting the ground. A cavity A is defined by the bottom surface 13 and concave toward an upper surface of the base, and the cavity A and the receiving chamber 40 are separated by a wall 14. The upper surface is formed with at least one (four in the present embodiment) engaging bore 15 that communicates the cavity A. The engaging bores 15 and the receiving chamber 40 are isolated from each other, and the engaging bores may be formed with inner threads.

The support portion 20 is disposed on the base 10 and may consist of a rod 21. a cushion 22 and a positioning shank 23 to provide the boxing training device with some cushioning effects. The positioning shank 23 is fixed to the base 10 by at least one screw engaging with the engaging bores 15. As such, the support portion 20 is removably installed on the base 10, and the beaten force can be transmitted to not only the upper surface but also the bottom surface 13 because of the engaging bores and the screws, thus the base of the present invention provides better mechanical strength. In the present embodiment, the positioning shank 23 completely covers the cap 12 and the opening 11 such that the cap 12 does not directly expose to the surrounding. The rod 21 extends toward a direction away from the bottom surface, i.e. the support portion 20 extends upward. The hit portion 30 is substantially ball shaped, and it is removably disposed on a distal end of the support portion 20. The hit portion 30 is fixed to the support portion 20 by at least one fastening element 24. A cushion pad 25, such as a foam pad or the like, sleeves around the support portion 20 and covers the fastening elements 24. As such, the trainee may not accidentally hit the fastening element 24 and get hurt. A size of the hit portion 30 corresponds to that of the cavity A, such that the hit portion 30 can he stored in the cavity as the hit portion 30 is removed from the support portion 20.

Please refer to FIGS. 1 to 5. The receiving chamber 40 may be filled with ballast such as water, sand or the like, and the cavity A is preferably disposed at the center of the bottom surface 13, so that a center of gravity of the base 10 centers on the cavity A. As such, the boxing training device may stand still while beaten upon by the trainee. When the device is not at use, the ballast can be evacuated from the chamber to reduce the weight of the base 10. For transportation purpose, two concave portions 16 can be further formed on the bottom surface 13 and disposed on two opposite sides of the base 10 for the user to hold.

The hit portion 30 of the present invention may be inflatable, i.e. the hit portion 30 may be selectively stuffed with stuffing material, such as air, cotton or the like, to provide a larger volume for training purpose. The hit portion 30 is compressed as the stuffing material is withdrawn from the hit portion 30. Thus the hit portion 30 can be easily stored in the cavity A.

Note that even when the hit portion is stored in the cavity, several bases may still be stacked up to further reduce the storage space. Therefore, the transportation and storage cost can he reduced.

What is claimed is:

1. A boxing training device, comprising:

a base, being a blow-molded hollow plastic body, the base defining a receiving chamber therein, the base having a bottom surface, a cavity being defined by the bottom surface and concave toward an upper surface of the base, the base being formed with an opening communicating the receiving chamber, a cap being mounted on the opening to enclose the receiving chamber, which is to be filled with ballast;

a support portion, removably disposed on the base and covering the cap as well as the opening, the support portion extending toward a direction away from the bottom surface, a cushion being disposed on the support portion;

a hit portion, removably disposed on a distal end of the support portion, a size of the hit portion corresponding to that of the cavity, and the hit portion being adapted to he stored in the cavity as the hit portion being removed from the support portion.

2. The device of claim 1, wherein the upper surface is formed with at least one engaging bore that communicates the cavity, the support portion is fixed to the base by at least one screw engaging with the at least one engaging bore.

3. The device of claim 2, wherein the at least one engaging bore and the receiving chamber are isolated from each other.

4. The device of claim 3, wherein the hit portion is fixed to the support portion by at least one fastening element, a cushion pad sleeves around the support portion and covers the at least one fastening element.

5. The device of claim 4, wherein the hit portion is selectively stuffed with stuffing material to become solid, the hit portion is compressed as the stuffing material is withdrawn from the hit portion.

6. The device of claim 5, wherein the ballast is stuffed into the receiving chamber from the opening, the cavity is disposed at the center of the bottom surface, and a center of gravity of the base centers on the cavity.

7. The device of claim 6, wherein the bottom surface being formed with two concave portions disposed on two opposite sides of the base.

* * * * *